US006572411B1

(12) United States Patent
Aeschbacher et al.

(10) Patent No.: US 6,572,411 B1
(45) Date of Patent: Jun. 3, 2003

(54) MODULAR JACK WITH MAGNETIC COMPONENTS

(75) Inventors: Michel Aeschbacher, Grandfontaine (FR); Yakov Belopolsky, Harrisburg, PA (US); Brad Brubaker, Mechanicsburg, PA (US); Robert E. Marshall, Elizabethtown, PA (US); John Spickler, Columbia, PA (US); Bonita L. Wheeler, Red Lion, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/996,556

(22) Filed: Nov. 28, 2001

(51) Int. Cl.[7] ..... H01R 13/66

(52) U.S. Cl. ..... 439/620; 439/676; 439/608; 439/540.1; 439/65

(58) Field of Search ..... 439/620, 676, 439/607, 608, 540.1, 65, 701

(56) References Cited

U.S. PATENT DOCUMENTS

| | | | | |
|---|---|---|---|---|
| 5,443,398 A | | 8/1995 | Ortega | 439/378 |
| 5,531,612 A | | 7/1996 | Goodall et al. | 439/541.5 |
| 5,639,267 A | | 6/1997 | Loudermilk | 439/701 |
| 5,672,064 A | | 9/1997 | Provencher et al. | 439/79 |
| 5,785,537 A | | 7/1998 | Donahue et al. | 439/79 |
| 5,879,199 A | | 3/1999 | Belopolsky | 439/701 |
| 5,924,890 A | | 7/1999 | Morin et al. | 439/490 |
| 5,924,898 A | | 7/1999 | Dutton et al. | 439/701 |
| 5,971,805 A | | 10/1999 | Belopolsky et al. | 439/620 |
| 6,019,631 A | | 2/2000 | Chen | 439/541.5 |
| 6,036,547 A | | 3/2000 | Belopolsky et al. | 439/626 |
| 6,102,741 A | * | 8/2000 | Boutros et al. | 439/620 |
| 6,176,741 B1 | * | 1/2001 | Shutter | 439/620 |
| 6,183,300 B1 | | 2/2001 | Belopolsky et al. | 439/607 |

* cited by examiner

*Primary Examiner*—Tho D. Ta
(74) *Attorney, Agent, or Firm*—Woodcock Washburn LLP

(57) ABSTRACT

A modular jack for housing magnetic components includes a housing which has a plurality of ports each of which can receive an electrical connector. Extending into each of the ports are a plurality of contacts for connecting to contacts of an electrical connector. The ports may be arranged in a stacked configuration in which case the modular jack is a double deck jack. Attached to the housing may be one or more magnetic housing. Each magnetic housing can house at least one magnetic component, which can be a transformer. Preferably, there is a magnetic housing for every two ports, and the magnetic housing houses a magnetic component for each port. Shields an be installed into the housing between the magnetic components in order to provide isolation of the components. A printed wire board can be attached to the magnetic housing, and a contact carrier having a plurality of contacts can be attached to the printed wire board. The contacts of the housing, the contacts of the contact carrier and the magnetic components of the magnetic housing can be in electrical communication through the printed wire board. The contact carrier can be attached to another electrical component such as a printed circuit board.

27 Claims, 13 Drawing Sheets

MODULAR JACK WITH MAGNETIC COMPONENTS

FIELD OF THE INVENTION

This invention relates to electrical connectors including a modular jack that can house magnetic components.

BACKGROUND OF THE INVENTION

Various types of modular jacks exist in the prior art. Typically, such jacks are used for connecting electrical components. The Electronics Industry Association and the Telecommunications Industry Association have established categories of such modular jacks, which those skilled in the art will recognize as category 3, category 4 and category 5. Various types of modular jacks have been developed including those set forth in Berg Technology, Inc.'s U.S. Pat. Nos. 5,879,199 and 6,036,547. This invention relates to an improved modular jack and includes an improved modular jack which can house a magnetic component.

SUMMARY OF THE INVENTION

A modular jack for housing a magnetic component according to this invention includes a housing and a magnetic housing coupled to the housing. The housing has at least one port for receiving an electrical connector, and the magnetic housing has at least one enclosure for housing a magnetic component. The modular jack can connect to two electrical components including for example a printed circuit board and a connector.

The connector is preferably sized and shaped so as to correspond to the size and shape of the port, so that the connector can be inserted into the port and be placed in electrical communication with the housing.

The housing may have a plurality of ports, which may be disposed such that there are two rows of ports. An electrical connector can be inserted into each of the housing ports. When the jack has two rows of ports, it may be known as a double deck modular jack. The housing preferably has a wall with a plurality of grooves and a plurality of contacts extending through the grooves into the ports. When an electrical connector is inserted into one of the ports, the connector's contacts mate with the housing contacts which extend into the respective port.

The magnetic housing may have two enclosures each of which can house a magnetic component. The jack may have a plurality of magnetic housings and preferably one magnetic housing for every two ports which are disposed in vertical alignment with each other. The magnetic housing may also have an enclosure through which the contacts extending from the ports extend.

Extending from the magnetic housing may be a plurality of wire retaining members. When a magnetic component is placed within an enclosure of the magnetic housing, the wires extending from the magnetic component can be threaded through the wire retaining members. Preferably, the wire retaining members have two prongs so that the wire can be threaded between the prongs.

The jack may also have a plurality of shields which are disposed proximate to each enclosure of the magnetic housing. The shields provide magnetic insulation for the magnetic components disposed within the magnetic housing. The shields may be disposed in a vertical pattern between each magnetic housing and in a horizontal pattern between each enclosure of the magnetic housing.

The jack may further include a printed wire board having a plurality of holes. The wire retaining members of the magnetic housings and the contacts extending from the ports of the housing can extend through the holes to the printed wire board.

The jack may also have a contact carrier which is coupled to the magnetic housing. Disposed within the contact carrier may be a plurality of contacts. One end of the contacts can extend through the holes in the printed wire board. The other end of the contacts can extend from the contact carrier. When the modular jack is connected to another electrical component, such as a printed circuit board, the contacts extending from the contact carrier can be placed in electrical communication with the electrical component.

The jack of this invention can house a magnetic component, but it need not. The jack can be sold and used with and without magnetic components and thereby provide a single jack that can be used in either application.

Other features of the invention are described below.

DETAILED DESCRIPTION OF PREFERRED EMBODIMENTS

Figure 1:
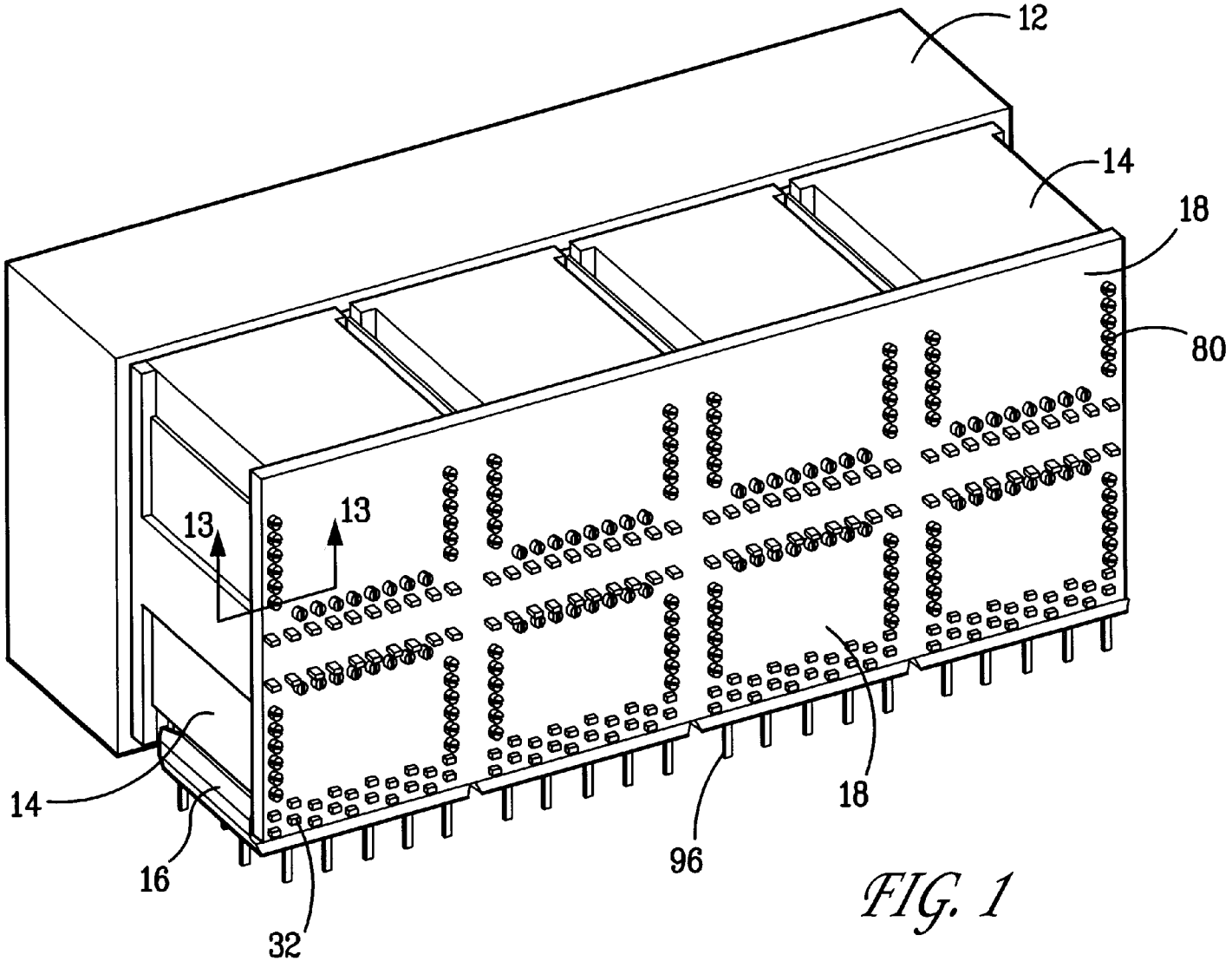
FIG. 1 is a perspective view of a jack according to a preferred embodiment of this invention.

A perspective view of a preferred embodiment of the modular jack 10 of this invention is depicted in FIG. 1. As shown, the modular jack 10 preferably includes a housing 12, a magnetic housing 14 and a contact carrier 16. Each of these components can be assembled by any of a variety of fastening techniques a preferred embodiment of which is described below. A printed wire board (PWB) 18 can also be used with the jack 10 and is preferably installed as shown in FIG. 1.

Figure 2:
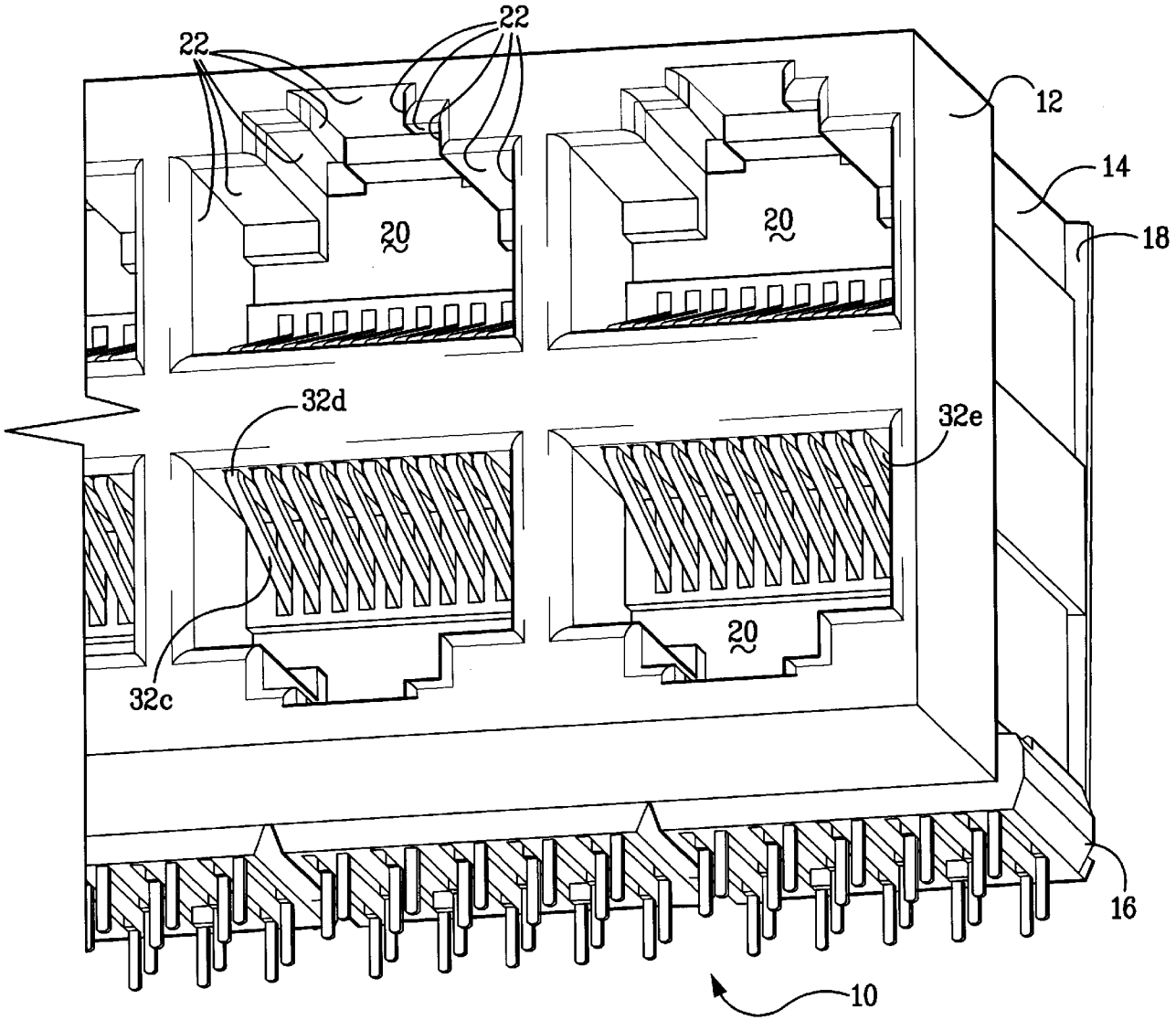
FIG. 2 is a back perspective view of the jack of FIG. 1.

The housing 12 is preferably formed from a thermoplastic material, but any suitable material can be used. The construction of the housing is best understood with reference to FIGS. 1–6. As shown in FIG. 2, which is a elevation view of the back of the housing 12, the housing preferably has at least one port 20 for receiving an electrical connector such as a standard jack (not shown). In the preferred embodiment shown, the housing 12 has 8 ports 20, but it will be appreciated that the housing 12 can be constructed with any number of ports 20. Moreover, although the preferred embodiment shown has two rows of ports 20 and may be referred to as a "double deck modular jack," it will be appreciated that the broad concepts of the invention expressed herein are not limited to any number of ports 20 or their specific arrangement.

The ports 20 are preferably designed to receive a standard electrical connector. In the embodiment shown, the ports are defined by a plurality of walls 22 that are shaped to specifically receive the connector for which the housing 12 is designed.

Figure 3:
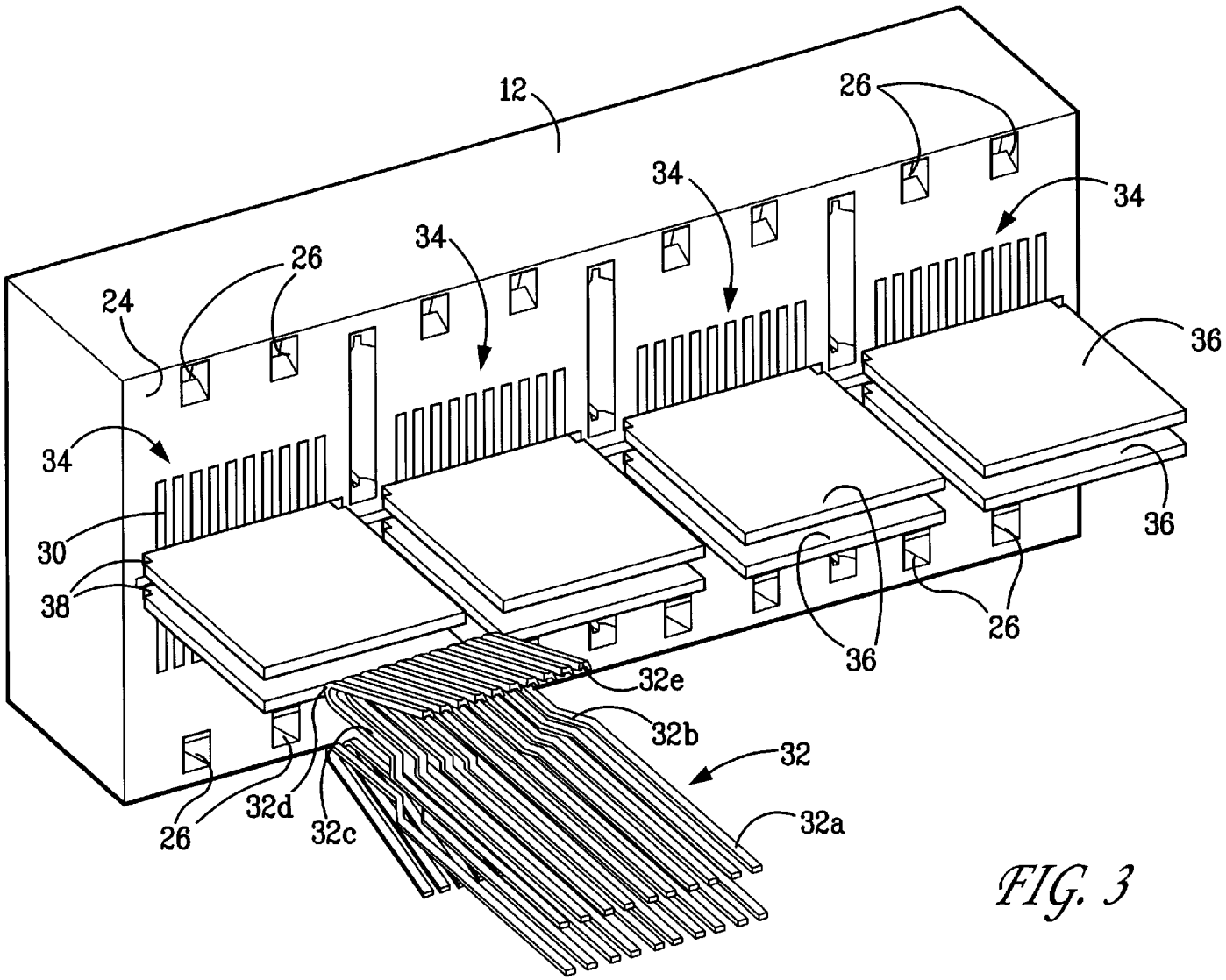
FIG. 3 is a perspective view of a preferred embodiment of a housing of the jack of FIG. 1 with the contacts, horizontal shield and vertical shield removed.

As shown in FIG. 3, which is a perspective view of the front of the housing 12, the housing 12 has a front side 24 which preferably has a plurality of openings 26. These openings 26 are for receiving tabs 28 of the magnetic housing 14 as described in further detail below, so that the magnetic housing 14 can be snap fit to the housing 12, as best understood with reference to FIGS. 1, 6 and 7. This is a preferred method of attaching the housing 12 and the magnetic housing 14 and any of a variety of other fastening techniques including but not limited to metal fasteners and adhesives can be employed.

Disposed within the front side 24 of the housing 12 are a plurality of grooves 30 as shown in FIG. 3. Preferably, each of the grooves 30 can receive a contact 32, a plurality of which are depicted in FIG. 3. Preferably, the grooves 30 can be divided into groups 34 which each correspond to a port 20. Each groove 30 within a set extends through the front side 24 and into the one of the ports 20 as is best understood with reference to FIGS. 2–4.

Figure 4:
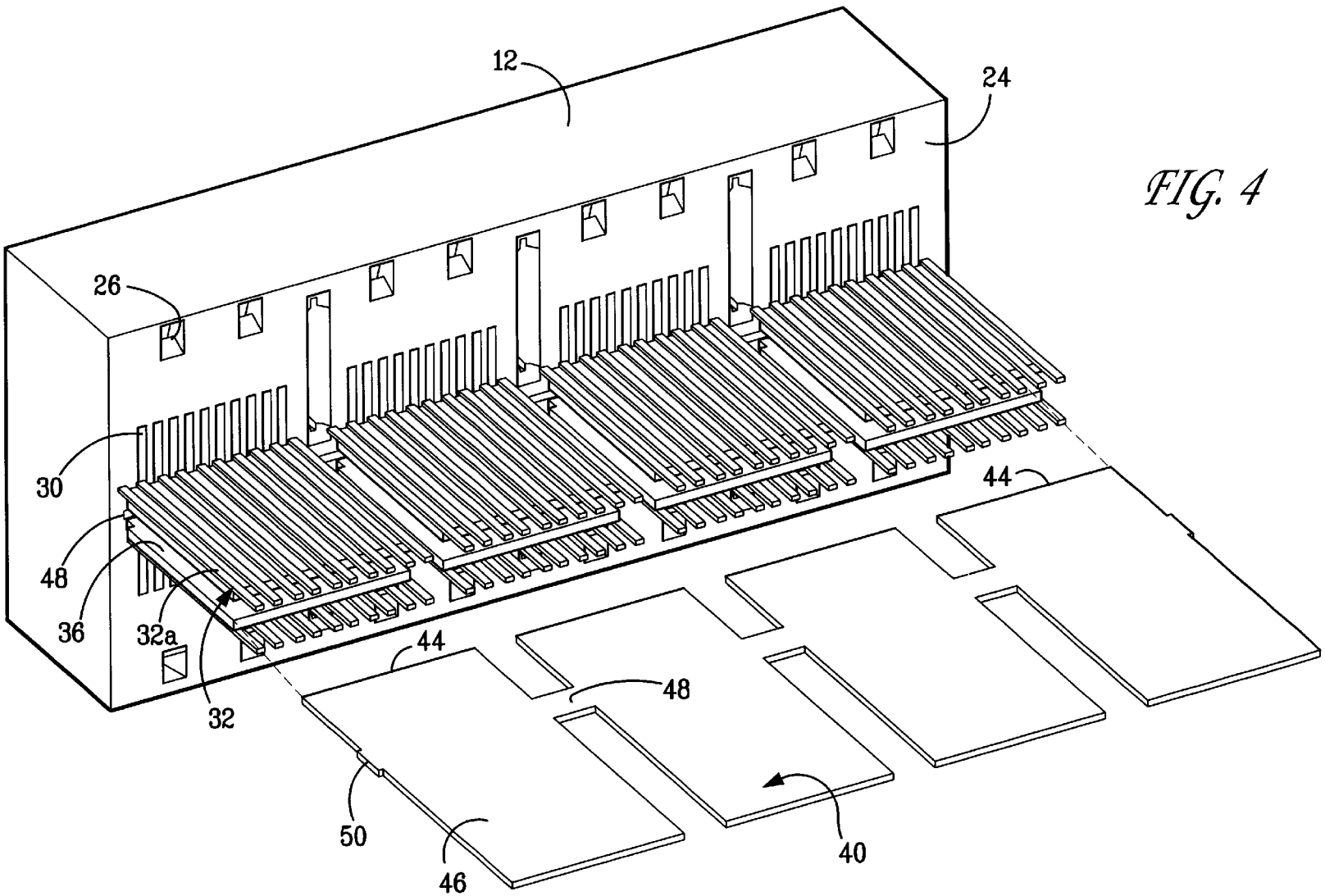
FIG. 4 is a perspective view of the housing of FIG. 3 with the contacts installed.

Extending from the first side 24 are preferably a plurality of fins 36 as shown in FIG. 3. The fins 36 can be molded as one piece with the housing 12 or alternatively the fins 36 can be separate pieces that are fit into slots 38 within the housing 12. The fins 36 are attached to the slots 38 within the housing 12 by any suitable means including but not limited to snaps, interference fits, mechanical fasteners and adhesives. As best shown in FIG. 4, the fins 36 define surfaces over which the contacts 32 extend.

Figure 5:
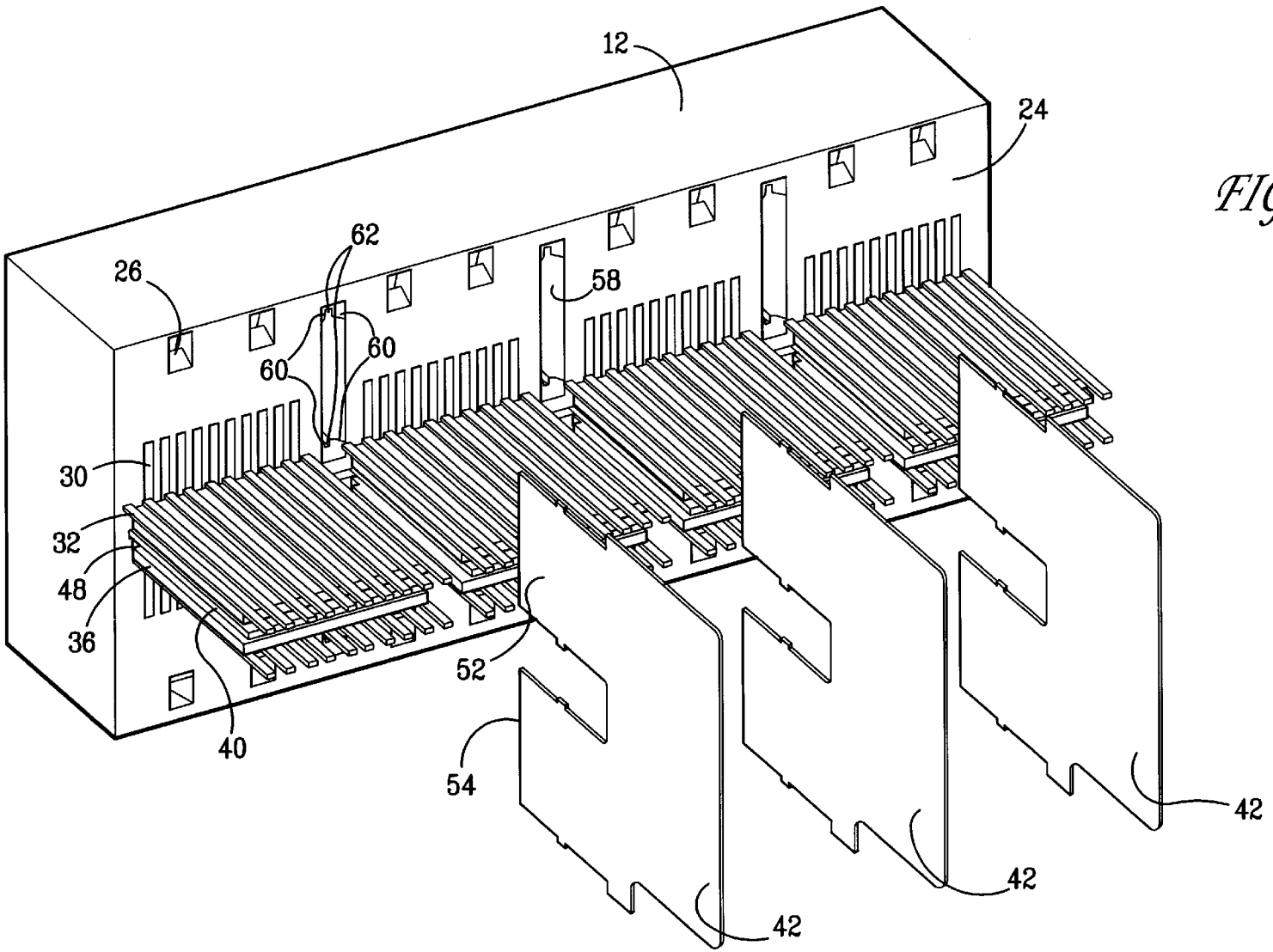
FIG. 5 is a perspective view of the housing of FIG. 5 with the contacts and horizontal shields installed.
Figure 6:
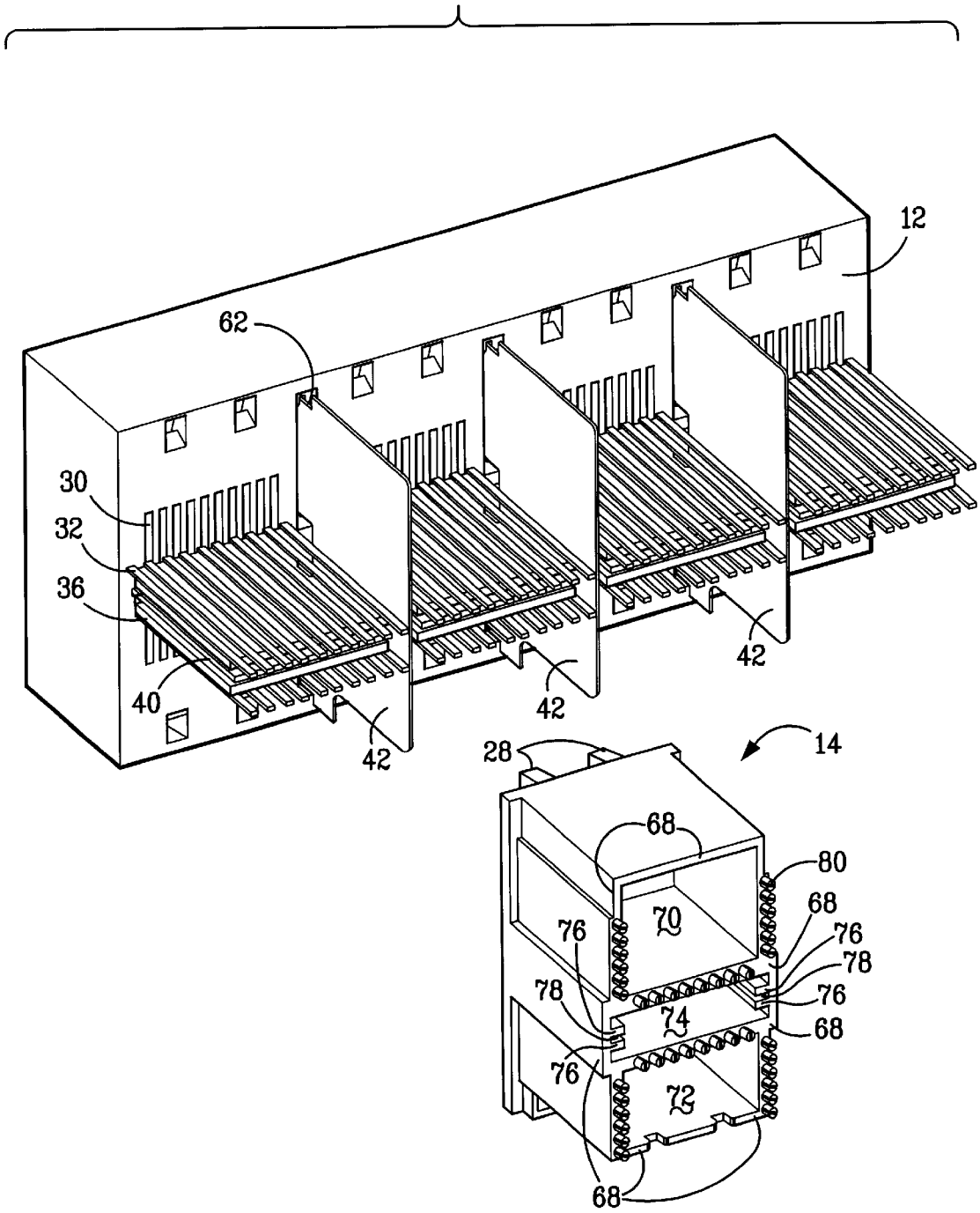
FIG. 6 is a perspective view of the housing of FIG. 2 with the contacts horizontal shields and vertical shields installed and of a magnetic housing according to a preferred embodiment of this invention.

The housing 12 preferably has a horizontal shield 40, as best shown in FIGS. 4 and 6, and at least one vertical shield 42, as best shown in FIGS. 5 and 6. The horizontal and vertical shields 40 and 42 are preferably each constructed from a thermoplastic material, but any suitable material will suffice. The horizontal shield 40 is preferably formed as a single piece. Alternatively, the horizontal shields 40 can be constructed from multiple pieces and fastened together with any suitable fastening technique. The vertical shields 42 are preferably formed as multiple pieces, as shown in FIG. 5.

As shown in FIG. 4, the horizontal shield 40 preferably includes a plurality of planes 46 which are connected by members 48. An end 44 of each plane 46 can be received into a slot 48 disposed within the housing 12. The horizontal shield 40 preferably has a plane 46 for every two vertically disposed ports 20. Extending from the two outer most planes 46 are a protrusion 50. When the planes 46 are inserted into the slots 48 of the housing 12, the protrusions 50 fit within a recess (not shown) which holds the shield 40 in the slots 40. Other suitable connection means may be employed including but not limited to an interference fit, mechanical fasteners and adhesives. The function of the horizontal shields 40 is to provide magnetic insulation between the first and the second enclosures.

As best shown in FIGS. 5 and 6, the vertical shields 42 are preferably all alike and each have a first extension 52 and a second extension 54. Disposed within the housing 12 are preferably a pair of slots 58 (one of which is shown in FIG. 5, but it will be appreciated that the lower slot has the same configuration as the upper slot) for each vertical shield 42. Within the slots 42, as shown in FIG. 5, are rails 60 which define grooves 62. Grooves 62 are shaped and sized to tightly receive an extension 52, 54 of one of the vertical shields 42 in an interference fit and hold the vertical shield 42 in place. FIG. 6 depicts the vertical shields 42 inserted into the slots 58 and grooves 62 so that the vertical shields 42 are attached to the housing 12. The vertical shields 42 may also have an extension 55 which fits into a corresponding slot (not shown) in the bottom most groove 62 to further support the electrical shield 42 when installed in the housing 12. Other fastening techniques may be employed. The function of the vertical shields is to magnetic insulate the magnetic components that are horizontally disposed in the magnetic housings, as described in more detail below.

As discussed above and as shown for example in FIGS. 2 and 3, the housing 12 preferably includes a plurality of contacts 32. In the preferred embodiment, the contacts 32 each have a first portion 32a that extends along one of the fins 36. Extending at an angle from the first portion 32*a* is a second portion 32*b*. Third portion 32*c* extends laterally from the second portion 32*b*. Each contact 32 preferably has a generally u-shaped portion 32*d*, and another lateral extending portion 32*e*. It will be appreciated that the contact 32 is constructed from metal and is relatively flexible. When the contacts 32 are inserted into the grooves 30, the laterally extending portions 32*e* are compressed by walls within the housing as best understood by reference to FIG. 2, which depicts the rear of the housing with the contacts 32 extending through the grooves 30. It will be appreciated that when a corresponding connector (one which corresponds to the port) is inserted into the port 20 the contact of the connector will contact and flex the contacts 32 to provide an electrical connection between the connector and the jack, as best understood with reference to FIG. 2.

Figure 7:
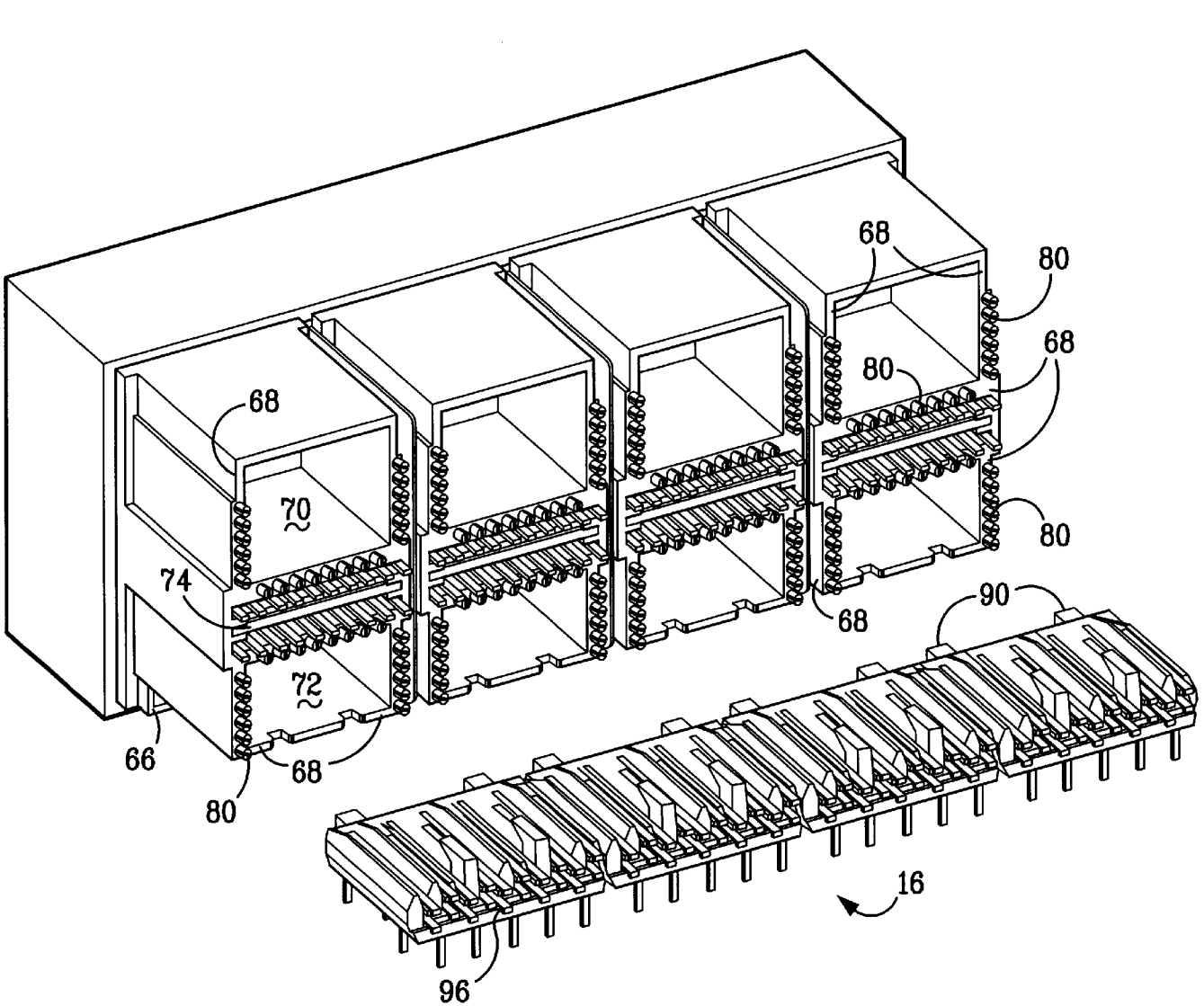
FIG. 7 is an assembly drawing of the housing of FIG. 2 with a plurality o magnetic housings of FIG. 6 installed and a preferred embodiment of a contact carrier shown in FIG. 1 removed.

FIG. 6 depicts the front of the housing 12 with the contacts 32, the horizontal shields 40 and the vertical shields 42 installed, and one of the magnetic housings 14 removed. FIGS. 1 and 7 depict the housing 12 with a plurality of magnetic housings 14 coupled to the housing 12. It will be appreciated that FIG. 7 is a depiction of FIG. 1 with the printed wire board removed so that the assembly of the housing 12 and the magnetic housings 14 can be better understood. In a preferred embodiment, the jack 10 has a plurality of magnetic housings 14. Alternatively, it will be appreciated that the plurality of magnetic housings 14 can be constructed in one piece. Preferably, each magnetic housing 14 is constructed to correspond to two ports, a lower and a corresponding upper port, as shown in FIGS. 6 and 7.

Figure 8:
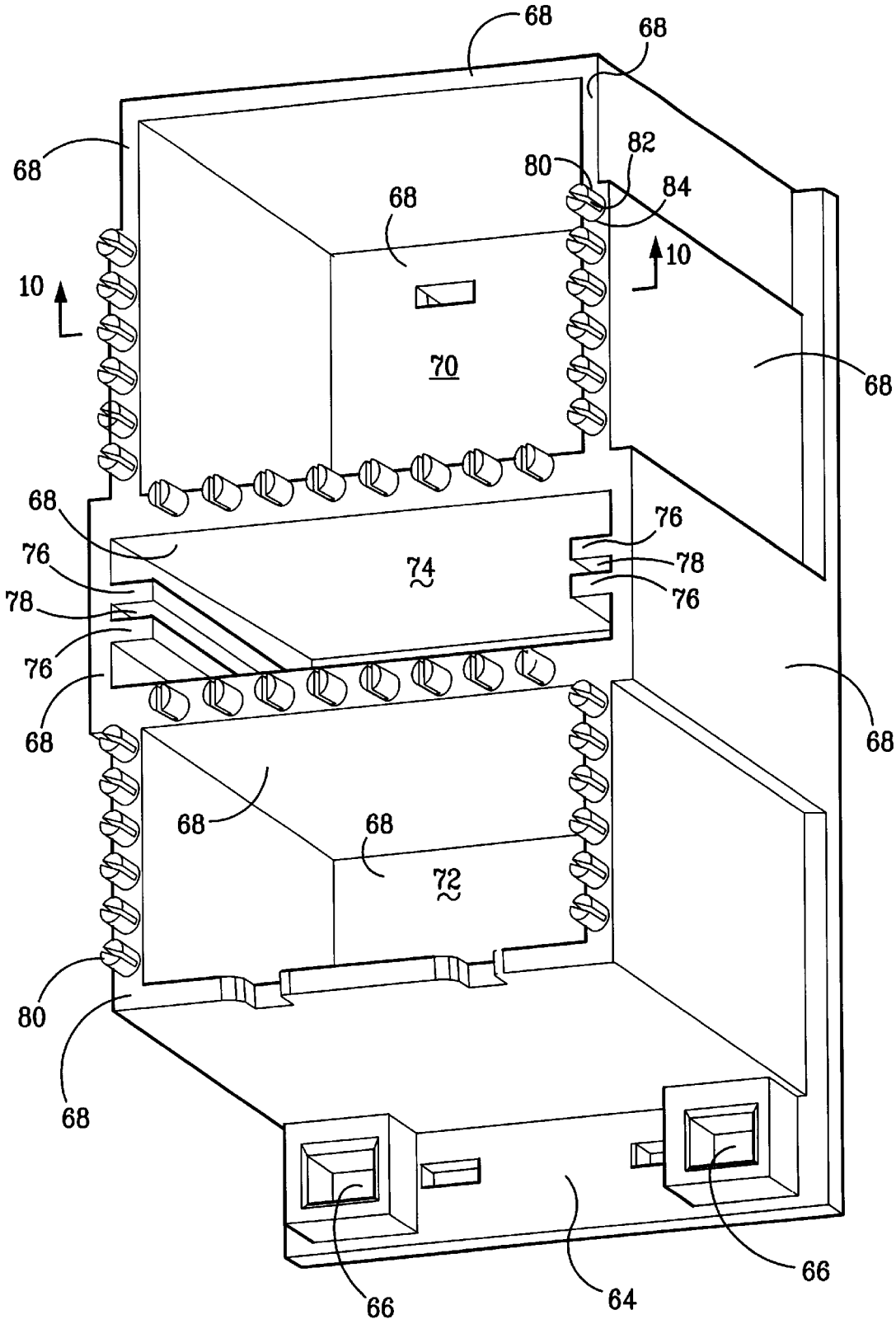
FIG. 8 is a front perspective view of the magnetic housing of FIG. 6.
Figure 9:
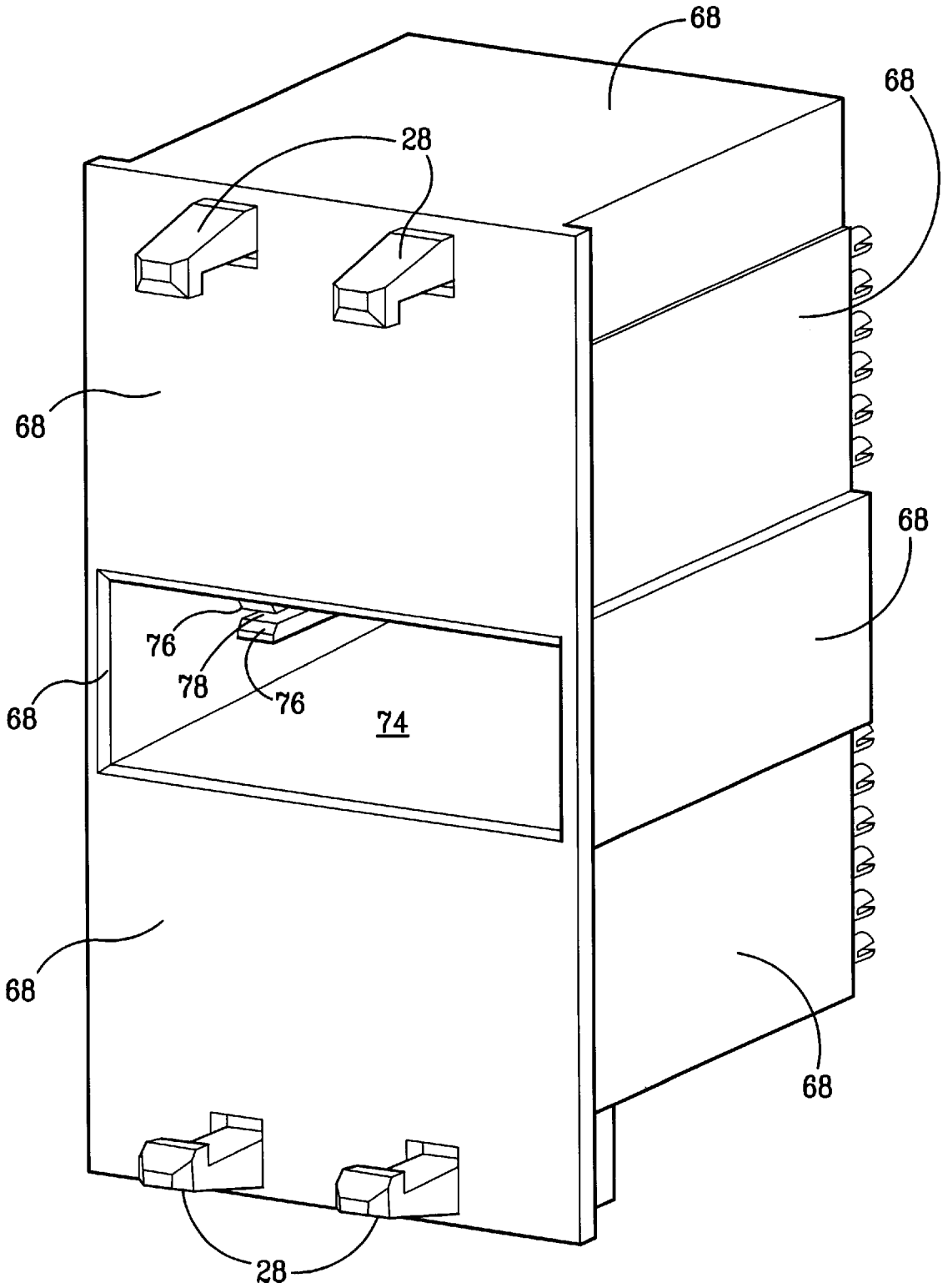
FIG. 9 is a back perspective view of the magnetic housing of FIG. 6.

The jack 10 preferably has a plurality of magnetic housing 14 of the type shown in FIGS. 6, 8 and 9. FIG. 8 a front perspective view depicting the lower portion of the magnetic housing of FIG. 6, and FIG. 9 is a rear perspective view depicting the back of the magnetic housing 14 of FIG. 6. As best shown in FIG. 9, each magnetic housing 14 preferably has a plurality of snaps 28. In the preferred embodiment shown and as best understood with reference to FIGS. 6, 7 and 9, the snaps 28 fit into the openings 26 of the housing 12 in order to assemble the magnetic housings 14 to the housing 12. Preferably, there are two sets of snaps 28, one at the upper part of the magnetic housing 14, and one at the lower part, as shown in FIG. 9. Although snaps 28 are used in the preferred embodiment shown, any suitable means may be used to attach the magnetic housings 14 to the housing 12.

As shown in FIG. 8, the magnetic housings 14 may have a lower portion 64, which has holes 66. Holes 66 are for receiving a portion of the contact carrier 16 and attaching the contact carrier 16 to the respective magnetic housing 14.

As is best shown in FIGS. 6, 8 and 9, the magnetic housings 14 each have a plurality of walls 68 which define a first enclosure 70, a second enclosure 72 and a third enclosure 74. The third enclosure 74 is, as will be appreciated with reference to FIG. 7, for receiving the contacts 32 of an upper and a corresponding lower port 20 as well as a fin 36 and a horizontal shield 40. As shown in FIGS. 6, 8 and 9, the portion of the walls 68 which define the third enclosure 74 may have a pair of rails 76 which define a groove 78. The grooves 78 are sized and shaped so at to receive a fin 36, as best understood with reference to FIGS. 6 and 7. Other mechanisms may be used to support the fins 36 as they extend into the magnetic housing 14 when the magnetic housing 14 is assembled to the housing 12 as shown in FIG. 7.

Figure 10:
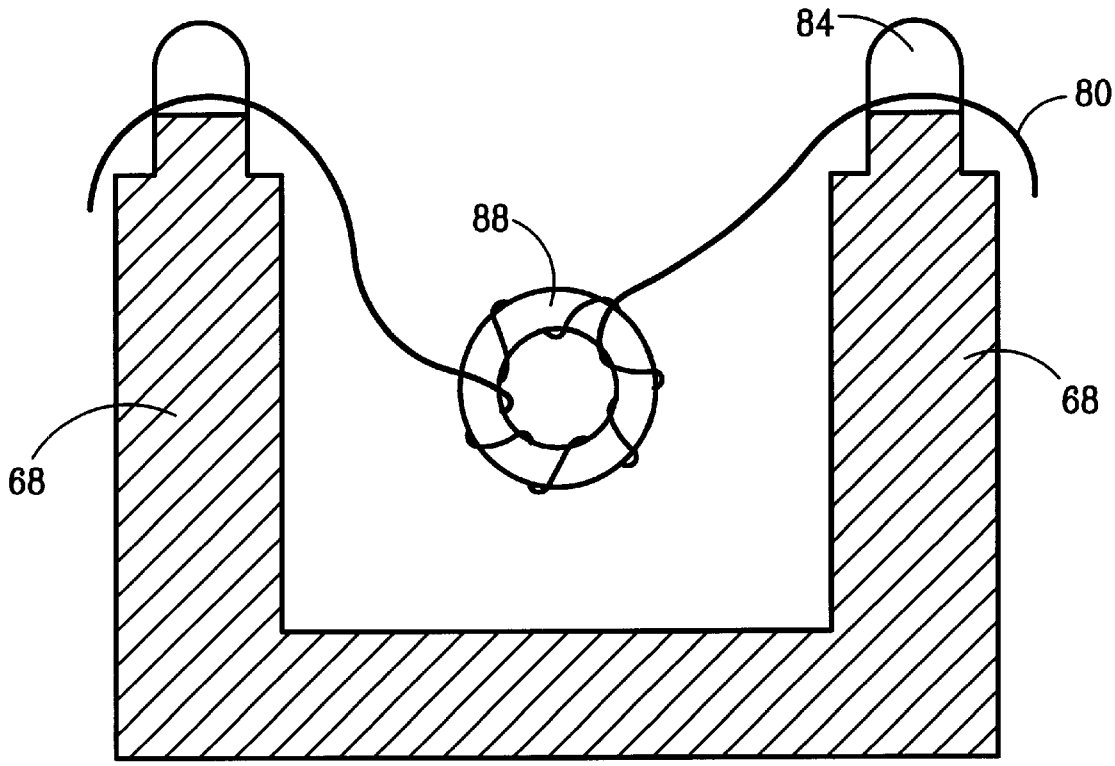
FIG. 10 is a cross section taken along line 10—10 of FIG. 8 with a magnetic component installed.

The first enclosure 70 and the second enclosure 72 are each for housing at least one magnetic component 88, including but not limited to a choke or a transformer. One such magnetic component 88 is depicted in FIG. 10, the cross-section taken through FIG. 7. The specific magnetic component 88 housed in the first and the second enclosures 70, 72 depends upon the application of the jack 10.

The magnetic housing 14 may further have a plurality of wire retaining members 80, as shown in FIG. 8. Wire retaining members 80 can be integrally formed with the magnetic housing 14 or attached as separate components. Although the wire retaining members can have a variety of embodiments, in the embodiment depicted the each wire retaining members includes prongs 82, 84. FIG. 10 depicts a cross-section taken through line 10—10 of FIG. 7. As shown, a wire 86 can be threaded through the wire retaining member 80. The wire 80 extends from a magnetic component 88, as shown in FIG. 10, which is housed in the respective enclosure of the magnetic housing 14. As shown in FIG. 10, the wire 80 extends from a wire retaining member 80 on one side of the magnetic housing 14 to a wire retaining member 80 on the other side of the magnetic housing 14.

As shown in FIG. 7, the magnetic housing 14 has a plurality of wire retaining members 80. The magnetic housing 14 can be manufactured to have the desired number of retaining members 80. In the preferred embodiment shown, the wire retaining members 80 are disposed so that they extend from the front side of the magnetic housing 14 and along three sides of the first and the second enclosures 70, 72. Wires 80 from the magnetic component 88 can be threaded into the wire retaining members 80 in any pattern desired. The wire retaining members 80 can also be used to connect the magnetic housings 14 to the printed wire board 18, as shown in FIG. 1 and as described in more detail below.

Figure 11:
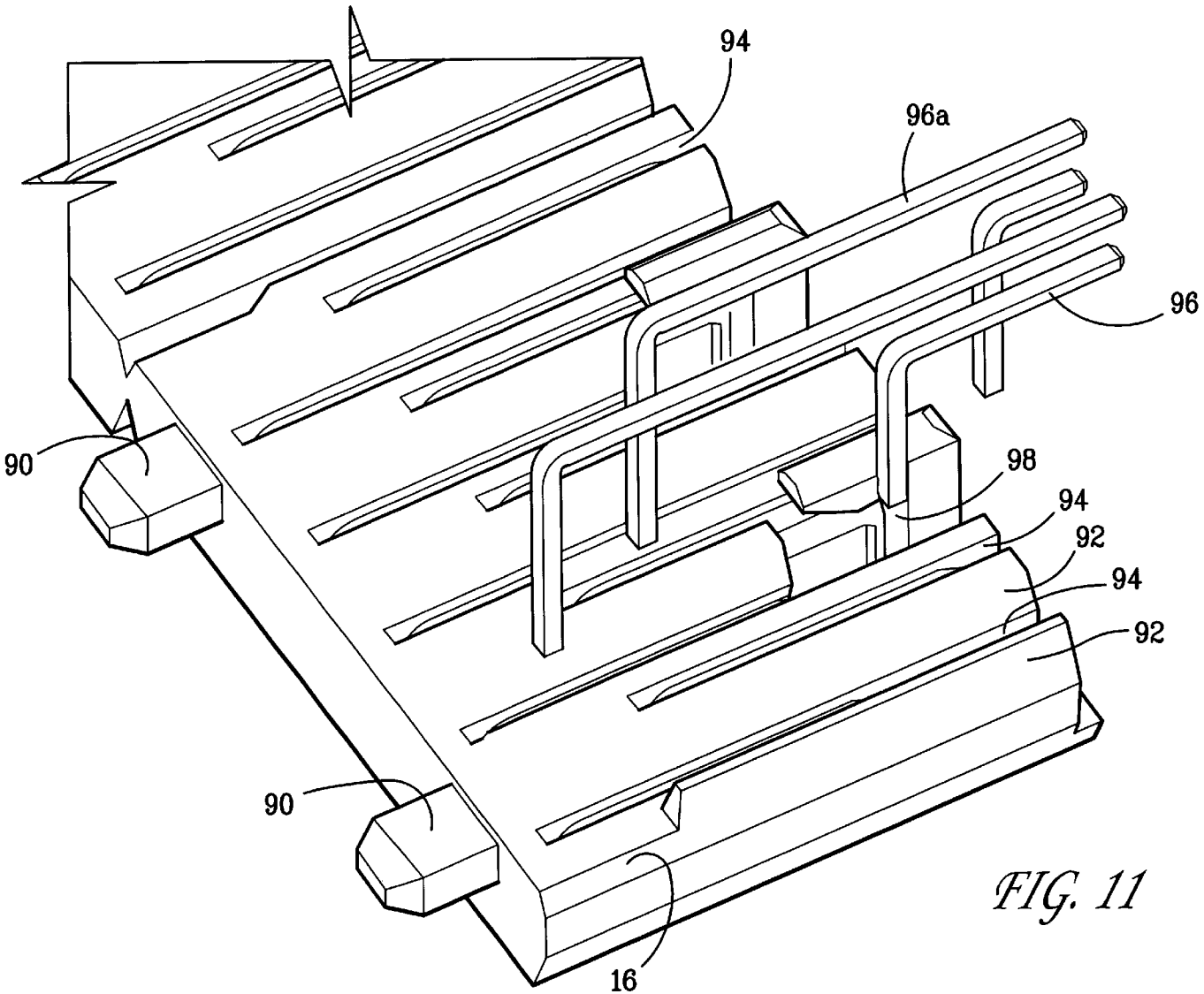
FIG. 11 is a perspective view of a portion of the contact carrier of FIG. 7 with the contacts removed.
Figure 12:
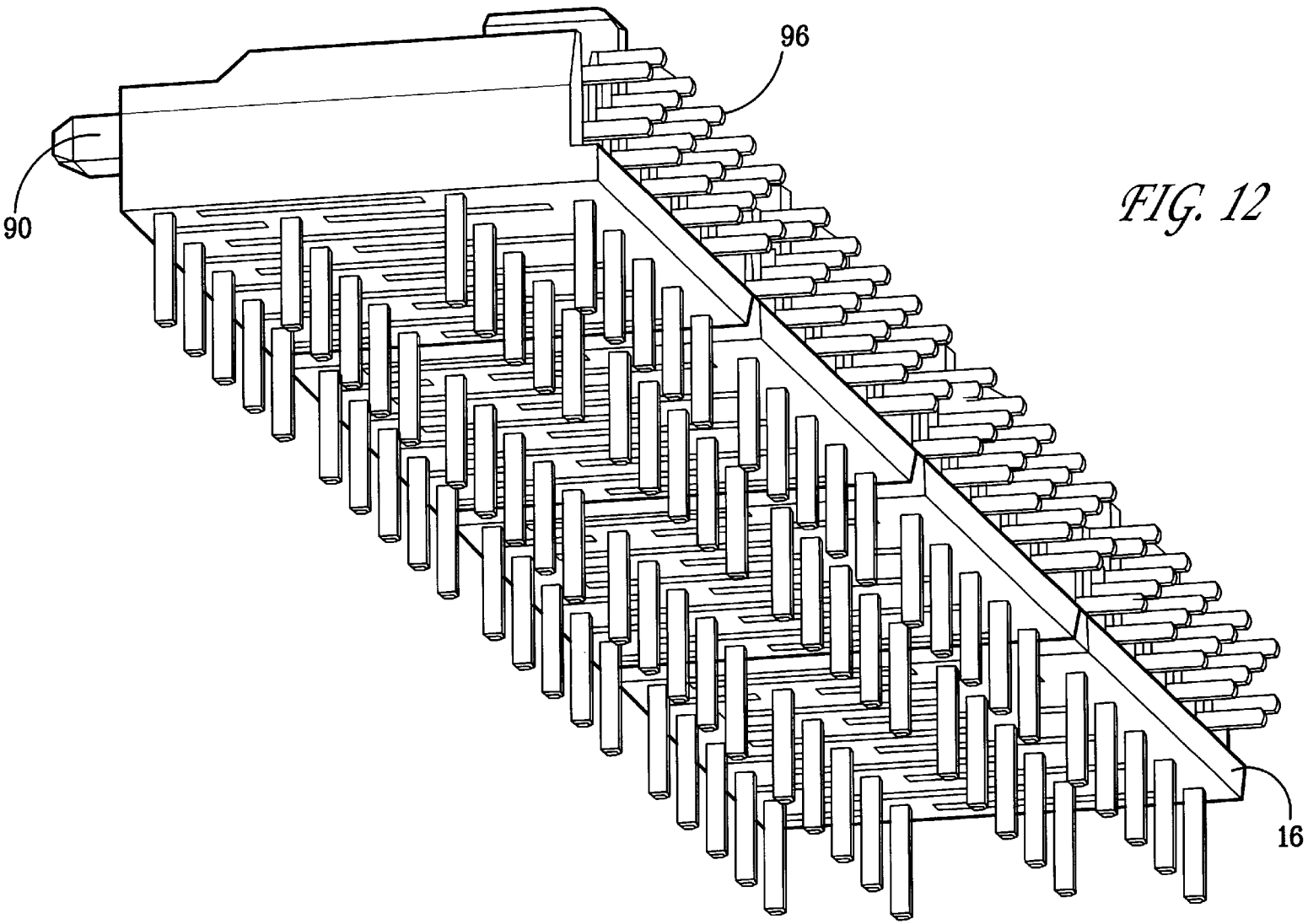
FIG. 12 is a perspective view of the under side of the contact carrier of FIG. 7.

FIGS. 1 and 2 depict an embodiment of a contact carrier 16, which can be used with a preferred embodiment of this invention, installed into the jack 10. FIG. 2 depicts the underside of the contact carrier 16 when installed into the jack 10. FIG. 7 depicts a perspective view of the top of the contact carrier 16, and FIG. 12 depicts a perspective view of the contact carrier 16 as viewed from its underside. FIG. 11 depicts a perspective view of the contact carrier 16 with the contacts 96 removed.

The contact carrier 16 can be manufactured from a thermoplastic or any suitable material, and may be formed through a molding process. As shown in FIG. 7, the contact carrier 16 may have a plurality of tabs 90 extending from its rear side. Preferably, there are a corresponding number of tabs 90 for the number of holes 66 of the magnetic housing 14. The tabs 90 preferably are sized and shaped so as to fit snugly within holes 66 of the magnetic housing 14 as best understood with reference to FIGS. 1, 7 and 8. This creates an interference fit between the carrier 16 and the magnetic housing 14. Other attachment techniques can be utilized including but limited to other mechanical means including fasteners and adhesives.

Disposed within the contact carrier 16 may be a plurality of walls 92, which define a plurality of lateral grooves 94, as best shown in FIGS. 11 and 12. Each groove 94 can receive a contact 96, as best shown in FIG. 11. The lateral grooves 94 are preferably sized and shapes to correspond to the contacts 96. In the preferred embodiment show, the contacts 96 are bent at approximately a right angle and have a first portion 96*a* that fits within the lateral grooves 94. As shown, in FIG. 12, the contacts 96 are preferably sized so as extend from the contact carrier 16 so that they can interface with another component such as a printed wire board 18, as described below and as shown in FIG. 1.

The contact carrier 16 may also have a plurality of vertically extending openings 98, as shown in FIG. 11, into which a second portion 96*b* of the contacts 96 are inserted. Again, the openings 98 are sized and shaped to correspond to the contacts 96 so that when inserted the contacts 96 will fit snugly within the contact carrier 16. Again, other suitable means may be used to install the contacts 96. The contacts 96 preferably extend from the contact carrier 16, so that the contacts 96 can interface with another electrical component, including but not limited to a printed circuit board.

As shown in FIG. 1, the jack 10 can include a printed wire board 18. The printed wire board 18 preferably has a plurality of openings 102 for receiving contacts 96 of the contact carrier 16, contacts 32 of the housing 12 or wire retaining members 80 of the magnetic housings 14, as shown in FIG. 1. The openings 102 can be disposed in any suitable pattern that corresponds to the arrangement of contacts 96 on the contact carrier, the arrangement of contacts 32 in the housing 12 and the arrangement of the wire retaining members 80. The printed wire board 18 can be connected to the magnetic housings 14 and the contact carriers 16 by any suitable connection technique. The printed wire board 18 can also have circuits for any of a variety of applications.

Figure 13:
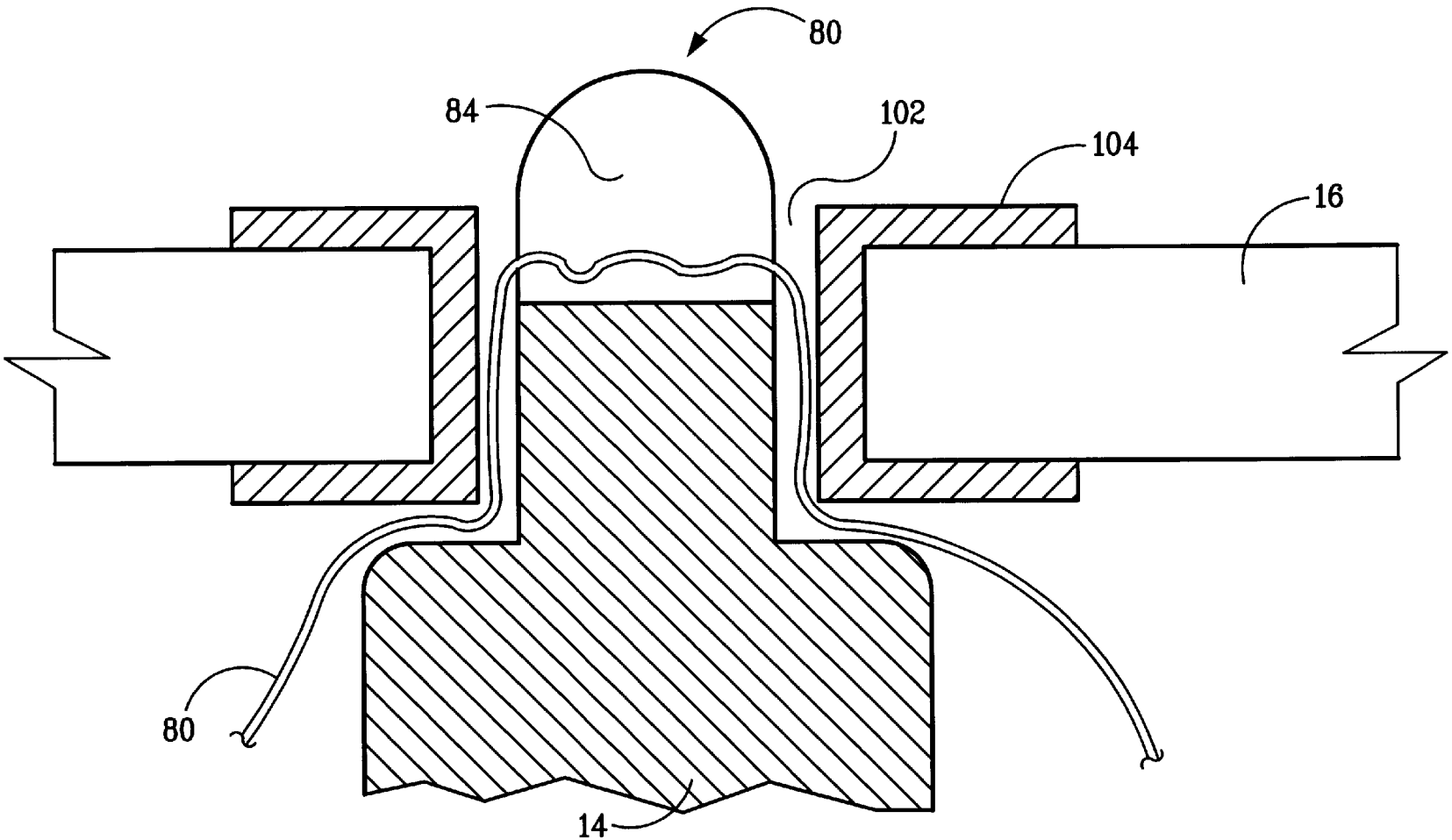
FIG. 13 is a cross section taken along line 13—13 of FIG. 1 with a wire installed.

FIG. 13 depicts a cross section taken along line 13—13 of FIG. 1 and shows the connection of the wire 80 from a magnetic component 88, which is shown in FIG. 10. As discussed above, the wire 80 from a magnetic component housed in the first enclosure can be threaded through the wire retaining member 80. The printed wire board 18 can be coated with a metal layer 104 around the part of the wire board which defines each opening 102. The metal layer serves to provide the electrical connection between the wires 80 and the printed wire board 18.

When assembling the jack 10, the contacts 32, the horizontal shields 40 and the vertical shields 42 are inserted into the housing 12 as best understood with reference to FIGS. 3–5. After which the magnetic housings 14 can be installed into the housing 12. Magnetic components can be inserted into the magnetic housings 14 and installed be wrapping the wires around the wire retaining members 80, as shown in FIGS. 10 and 11. The contact carrier can be attached to the magnetic housings 14 as shown in FIG. 1. The printed wire board 18 can then be attached to the magnetic housings 14 and the contacts of the contact carrier 16. This forms a jack 10 according to a preferred embodiment of this invention.

The jack 10 can have a variety of applications and is capable of housing magnetic components 88. For instance, the jack 10 can be coupled to a printed circuit board (not shown) and the ports 20 in the housing 10 can each receive an electrical connector (not shown), so that electrical signals can be transmitted between the connector through the jack 10 and to the component such as the printed circuit board.

Although the modular jack of this invention has a magnetic housing, it can be used with or without a magnetic component. Thus, the jack 10 provides a standard part that is versatile. The jack 10 can be stocked and if it is to be used with a magnetic component, such a component can be inserted into the housing. Conversely, if no magnetic component is to be used, the jack 10 can be used without any such component.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A modular jack, comprising:

a first housing comprising at least one port for receiving an electrical connector;

a first magnetic housing, coupled to the first housing, comprising a first enclosure for housing a first magnetic component and a second enclosure;

a first set of electrical contacts extending from the port and through the magnetic housing second enclosure; and a contact carrier coupled to the magnetic housing and comprising a second set of electrical contacts.

2. The modular jack of claim 1, wherein the first magnetic housing further comprises a plurality of wire retaining members.

3. The modular jack of claim 1, further comprising a printed wire board coupled to the magnetic housing.

4. The modular jack of claim 3, wherein the first and the second set of contacts extend through the printed wire board and are in electrical connection with the printed wire board.

5. The modular jack of claim 1, wherein the first magnetic housing further comprises a third enclosure for housing a second magnetic component.

6. The modular jack of claim 5, further comprising a shield disposed between the first and the third magnetic housing enclosures.

7. The modular jack of claim 1, wherein the first housing further comprises a second magnetic housing disposed adjacent to the first magnetic housing and the jack further comprises a shield disposed between the first and the second magnetic housings.

8. The modular jack of claim 7, wherein the shield is disposed within slots disposed in the first housing.

9. A modular jack, comprising:

(a) a housing comprising a plurality of ports, each of the ports being for receiving an electrical connector;

a wall which defines a side of the plurality of ports and which has a plurality of grooves and a plurality of openings;

a plurality of first contacts which extend through the grooves and into the plurality of ports;

(b) a magnetic housing, coupled to the housing, comprising:

a plurality of walls which define a first enclosure and a second enclosure each of which can receive a magnetic component;

a plurality of wire retaining members extending from the magnetic housing for receiving a wire from the magnetic component;

(c) a contact carrier coupled to the magnetic housing comprising a plurality of second contacts; and (d) a printed wire board, comprising a plurality of openings through which the plurality of first contacts, the plurality of second contacts and the wire retaining members extend.

10. The modular jack of claim 9, further comprising a shield disposed between the first and the second enclosures.

11. The modular jack of claim 9, wherein the magnetic housing further comprises a third enclosure through which the plurality of first contacts extend from the housing to the printed wire board.

12. The modular jack of claim 9, further comprising a magnetic housing for every two ports of the housing.

13. The modular jack of claim 12, further comprising a shield disposed between each magnetic housing.

14. A modular jack, comprising:

a housing comprising a plurality of first contacts and a plurality of ports each of which can receive an electrical connector and into which the plurality of first contacts extend;

a magnetic housing coupled to the housing and comprising at least one enclosure for housing a magnetic component, the magnetic housing have a plurality of wire retaining members extending from the housing which can retain a wire which extends from the magnetic component; and a printed wire board which has a plurality of openings through which the plurality of first contacts and the wire retaining members extend.

15. The modular jack of claim 14, further comprising a contact carrier coupled to the magnetic housing, which houses a plurality of second contacts, the plurality of second contacts each comprising a first end which extends though one of the openings of the printed wire board.

16. The modular jack of claim 15, wherein the plurality of second contacts further comprise a second end which extends from the contact carrier so that modular jack can be placed in electrical communication with an electrical component.

17. The modular jack of claim 16, further comprising a plurality of magnetic housings.

18. The modular jack of claim 17, further comprising a shield disposed between each magnetic housing.

19. The modular jack of claim 14, wherein the magnetic housing comprises two enclosures each of which can receive an electrical component.

20. The modular jack of claim 19, further comprising a shield disposed between the enclosures.

21. A modular jack, comprising:

a first housing comprising at least one port for receiving an electrical connector;

a first magnetic housing, coupled to the first housing, comprising a first enclosure for housing a first magnetic component, a second enclosure, and a third enclosure for housing a second magnetic component;

a first shield disposed in the second enclosure; and a first set electrical contacts extending from the port and through the first magnetic housing second enclosure.

22. The modular jack of claim 21, wherein the magnetic housing further comprises a plurality of wire retaining members.

23. The modular jack of claim 21, further comprising a contact carrier coupled to the first magnetic housing.

24. The modular jack of claim 23, further comprising a second set of electrical contacts disposed within the contact carrier.

25. The modular jack of claim 24, further comprising a printed wire board coupled to the magnetic housing and the second set of electrical contacts.

26. The modular jack of claim 21, wherein the first housing further comprises a second magnetic housing disposed adjacent to the first magnetic housing and the jack further comprises a second shield disposed between the first and the second magnetic housings.

27. The modular jack of claim 26, wherein the second shield is disposed within slots disposed in the first housing.

* * * * *